US005199788A

United States Patent [19]

Stallings

[11] Patent Number: 5,199,788

[45] Date of Patent: Apr. 6, 1993

[54] APPARATUS FOR SEALING A LIQUID CONTAINER

[76] Inventor: Dorothy Stallings, Rte. 1, Box 165C, Pattonville, Tex. 75468

[21] Appl. No.: 791,945

[22] Filed: Nov. 15, 1991

Related U.S. Application Data

[63] Continuation-in-part of Ser. No. 621,212, Dec. 3, 1990, abandoned, which is a continuation-in-part of Ser. No. 478,771, Feb. 12, 1990, Pat. No. Des. 320,398.

[51] Int. Cl.[5] ..... B01F 7/20

[52] U.S. Cl. ..... 366/247; 366/605

[58] Field of Search ..... 366/605, 244, 245, 246, 366/247, 248, 249, 251, 250, 254, 343, 308, 325, 326, 328, 329, 330, 331; 220/94 A, 352

[56] References Cited

U.S. PATENT DOCUMENTS

| | | |
|---|---|---|
| D. 4,001 | 4/1870 | Oblinger . |
| D. 122,155 | 8/1940 | Bernhardt . |
| D. 271,750 | 12/1983 | Karosi . |
| D. 276,404 | 11/1984 | Doyel . |
| D. 277,729 | 2/1985 | Maxwell . |
| D. 290,084 | 6/1987 | Klapperich . |
| D. 304,897 | 12/1989 | Lin . |
| D. 305,089 | 12/1989 | Thompson . |
| 785,249 | 3/1905 | Burnham . |
| 861,603 | 7/1907 | Newton . |
| 1,698,402 | 1/1929 | Harris . |
| 2,027,297 | 1/1936 | Tramposch . |
| 2,257,238 | 9/1941 | Hexter . |
| 2,585,334 | 2/1952 | McCauley . |
| 2,636,643 | 4/1953 | McCauley . |
| 2,643,661 | 6/1953 | Shanahan, Jr. . |
| 2,780,385 | 2/1957 | Tupper . |
| 2,795,405 | 6/1957 | Christopher . |
| 2,932,494 | 4/1960 | Wales . |
| 3,139,220 | 6/1964 | Darcy . |
| 3,326,533 | 6/1967 | Sturrup . |
| 3,596,813 | 8/1971 | Munn . |
| 3,704,007 | 11/1972 | Kroeger . |
| 3,860,990 | 1/1975 | Petruzzi . |
| 4,339,992 | 7/1982 | Kurland . |
| 4,380,399 | 4/1983 | Godat . |
| 4,407,584 | 10/1983 | Boudin . |
| 4,422,770 | 12/1983 | Geible . |
| 4,538,992 | 9/1985 | Johnson . |
| 4,907,714 | 3/1990 | Gatz . |
| 4,926,390 | 5/1990 | Murzsa . |
| 4,936,688 | 6/1990 | Cornell ..... 366/328 |

*Primary Examiner*—Robert W. Jenkins
*Attorney, Agent, or Firm*—Daniel V. Thompson

[57] ABSTRACT

An apparatus for sealing a liquid container includes a sealing member with an integral spout. A stirring member is rotatably connected to the sealing member, and a removable spout top is constructed and arranged to seal the spout.

13 Claims, 3 Drawing Sheets

APPARATUS FOR SEALING A LIQUID CONTAINER

CROSS REFERENCE TO RELATED APPLICATION

This application is a continuation-in-part of Ser. No. 07/621,212, filed Dec. 3, 1990, now abandoned, which was a continuation-in-part of Ser. No. 07/478,771, filed Feb. 12, 1990, now Design U.S. Pat. No. 320,938, issued Oct. 22, 1991.

TECHNICAL FIELD

This invention relates to liquid containers, and more particularly to an apparatus for sealing a liquid container.

BACKGROUND OF THE INVENTION

This invention relates to an improved apparatus for stirring paint or other liquids in containers as well as for pouring or transferring liquids from a source container to another container, such as a paint roller tray. While this invention is described in a preferred environment involving paint, it will be recognized that the invention is useful with many other types of liquids and in other environments such as, but not limited to, fruit juice containers.

Paint is typically sold to consumers in one gallon and one quart cylindrical metal cans. These cans have a substantially completely open top and a removable lid.

It is common to mix paint in such cans by stirring with a stick or an electric drill or by having it premixed by automatic shaking machinery at a paint retailer. These prior art methods of mixing are less than satisfactory, messy and inconvenient.

In addition, paint cans are typically filled to the brim, and thus stirring or dipping a brush usually causes an overflow of the paint into the lid engagement groove and down the side of the paint can. Paint in the groove then dries, thereby preventing effective resealing of the paint can. As a result, the paint within the can will dry during storage and, until it is dry, will spill if the paint can is knocked over. Similarly, wet paint in the groove will act as an adhesive to make removal of the lid difficult, sometimes resulting in excessive force being required to open the can such that the lid and groove are deformed.

Another drawback of the prior art practices involves the circular shape of paint cans and associated lid engagement grooves. In these configurations, pouring of the paint from circular cans to other containers, such as paint roller trays, is uncontrollable when the container is full and often results in spillage.

Thus, there presently exists a need for an integrated apparatus that provides liquid container sealing, stirring and pouring functions. The apparatus should be readily usable with conventional liquid containers, such as paint cans. Preferably, the liquid and any particulates within the container can be thoroughly mixed without any additional tools, accessories or outside power sources. Wastage by spilling should be obviated and prevented. Preferably, liquid can be poured without dripping from a source container to an auxiliary container for further storage or immediate application. Excessive bonding of the lid to the container should also be avoided. The device should be reusable from one container to another.

SUMMARY OF THE INVENTION

The present invention provides an apparatus for sealing a liquid container that includes a sealing member with an integral spout, a stirring member rotatably connected to the sealing member, and a removable spout top constructed and arranged to seal the spout. The stirring member includes a paddle member fixed at a top end to a crank member for corotation about a central axis.

BRIEF DESCRIPTION OF THE DRAWINGS

A more complete understanding of the invention and its advantages will be apparent from the Detailed Description taken in conjunction with the Drawings, in which.

DETAILED DESCRIPTION OF THE PREFERRED EMBODIMENT

Figure 1:
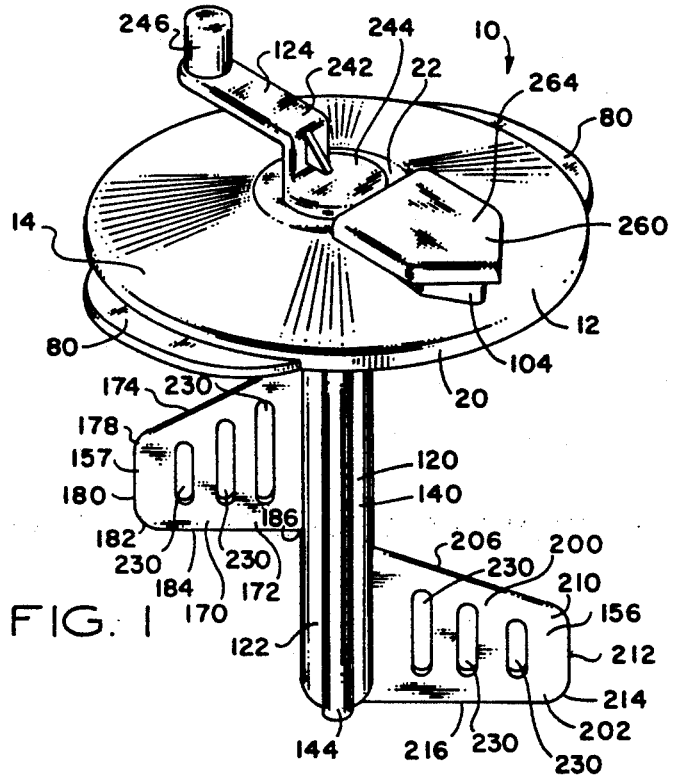
FIG. 1 is a perspective view of apparatus constructed in accordance with the invention.
Figure 2:
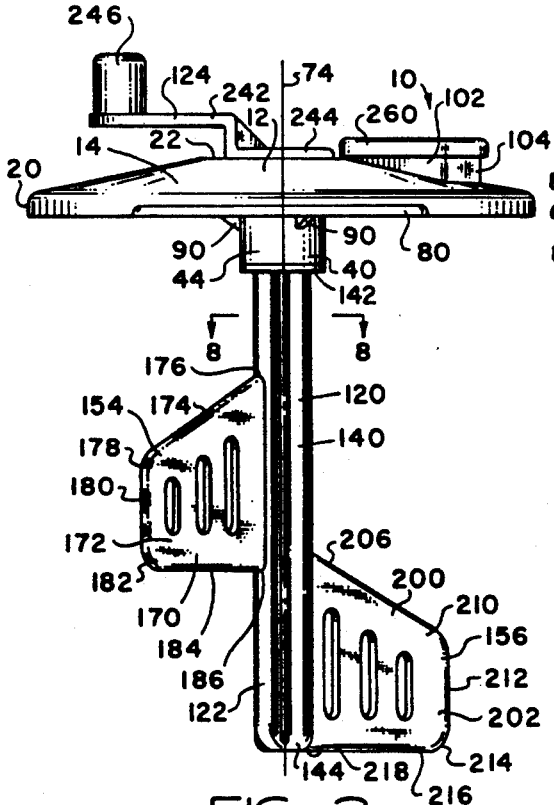
FIG. 2 is a side view of the apparatus of FIG. 1.
Figure 3:
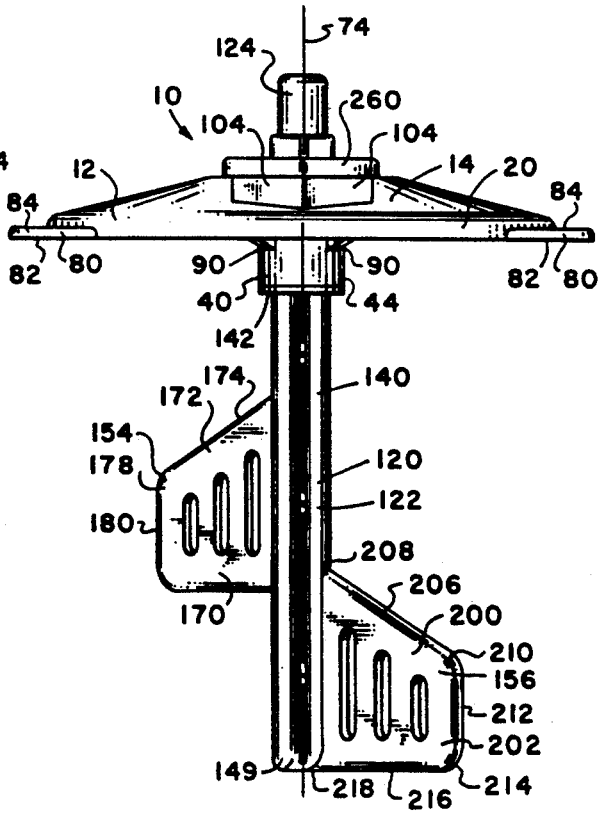
FIG. 3 is a front view of the apparatus of FIG. 1.
Figure 4:
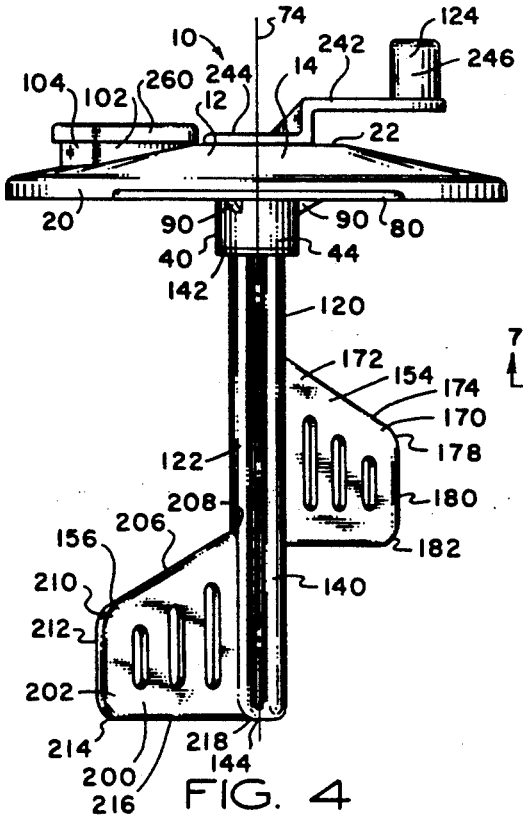
FIG. 4 is a side view of the apparatus rotated 180 degrees from FIG. 2.
Figure 5:
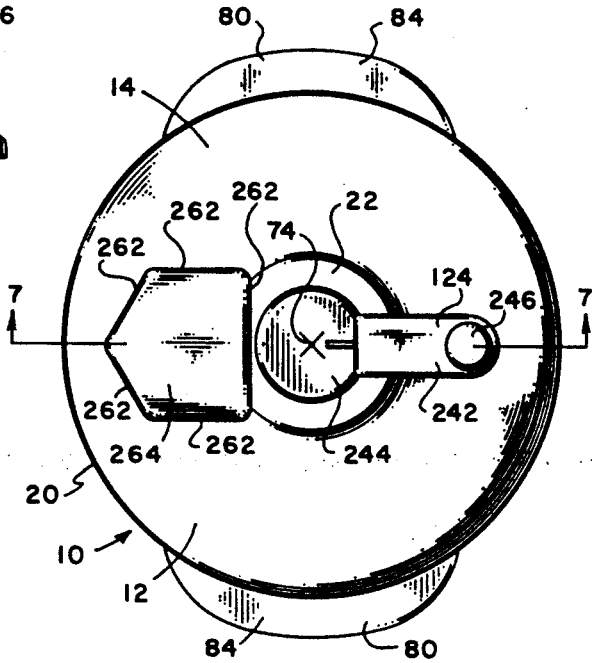
FIG. 5 is a top view of the apparatus.

Referring initially to FIGS. 1–9, where like numerals indicate like and corresponding elements, apparatus 10 is a device for sealing a liquid container having an opening. Apparatus 10 includes a one-piece molded plastic sealing member 12. Sealing member 12 has a frustroconical upper surface 14 and a frustroconical lower surface 16. A uniform-thickness sealing wall 18 spans between surfaces 14 and 16. Upper surface 14 extends upwardly and inwardly from a cylindrical outer rim surface 20 to an upper annular surface 22 having a central opening 24. Sealing member lower surface 16 extends upwardly and inwardly from an engagement member 26 to a lower annular surface 28.

A cylindrical bearing member 40 depends downwardly from the lower annular surface 28 to a bottom surface 42. Bearing member 40 has outer and inner cylindrical walls 44 and 46, respectively. Inner cylindrical wall 46 is contiguous with the upper annular surface central opening 24. Bearing member outer surface 44 adjoins the lower annular surface 28.

Figure 6:
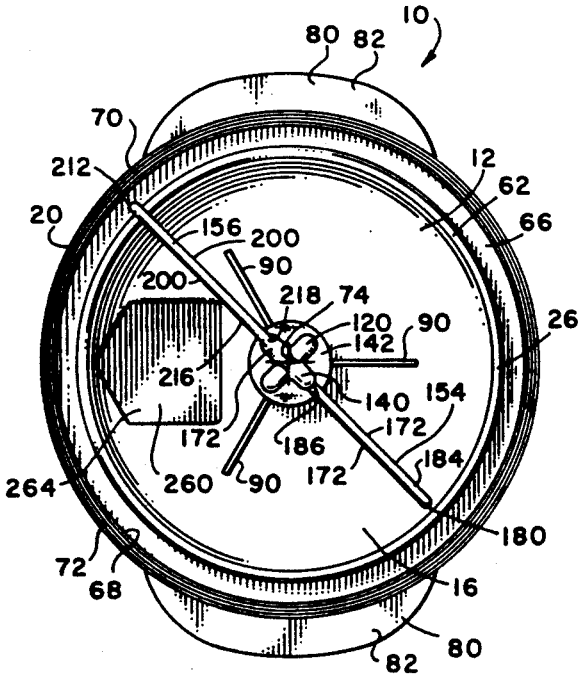
FIG. 6 is a bottom view of the apparatus.

Engagement member 26 has a cylindrical inner surface 60 extending downwardly from the sealing member lower surface 16 to a curved lower surface 62. Engagement member 26 further includes an outer cylindrical surface 64 extending upwardly from the curved lower surface 62 to an upper annular rim surface 66. Upper annular rim surface 66 extends horizontally outward to a cylindrical inner rim surface 68. A lower annular rim surface 70 extends between the outer and inner cylindrical rim surfaces 20 and 68, respectively. As best shown in FIG. 6, the lower annular rim surface 70 has a plurality of concentric circular grooves 72 to enhance gripability. Opening 24, walls 44, 46, and surfaces 14, 16, 20, 22, 28, 60, 62, 64, 66, 68, 70, are coaxial about a vertical central axis 74.

Two rim handles 80 extend outwardly from opposed portions of the rim outer surface 20. Rim handles 80 have lower surfaces 82 (FIG. 6) contiguous with the lower rim annular surface 70. Rim handles 80 further include upper surfaces 84 adjoining the outer rim surface 20 at locations located about ⅓ the height of the rim surface 20.

Three, equally-spaced, gusset members 90 join bearing member outer surface 44 to the lower annular surface 28 and sealing member lower surface 16.

Five spout walls extend vertically upward from the sealing member upper surface 14. The spout walls include a back wall 100, two side walls 102 joined at right angles to opposite ends 103 (FIG. 9) of the back wall 100, and two front walls 104 joined at equal, obtuse angles A to outer ends 105 of the side walls 102. Outer ends 105*a* of side walls 102 are joined to each other at an obtuse angle B. Spout walls 100, 102, 104 include coplanar, horizontal, top edges 106 forming a five-sided opening, with the front wall top edges 106 having inwardly-facing ridges 108 for preventing drips.

A stirring member 120 is rotatably connected to the sealing member 12. Stirring member 120 includes a one-piece, molded plastic paddle member 122 and a one-piece, molded plastic crank member 124. Paddle member 122 is fixed for corotation about the central axis 74 at a top end 126 to crank member 124.

The paddle member 122 has a shaft 140 depending from a bearing element 142 to a lower end 144. The bearing element 142 is a horizontal disc in close proximity to the bearing member bottom surface 42 and sized more largely than the bearing surface bottom surface 42.

Figure 8:
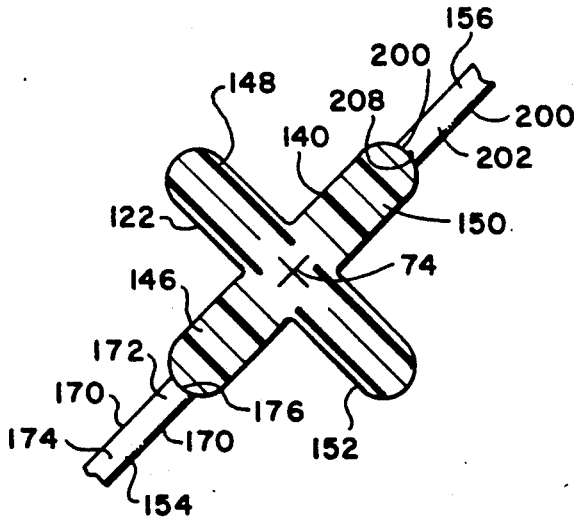
FIG. 8 is an enlarged cross-sectional view taken along lines 8—8 of FIG. 2.
Figure 9:
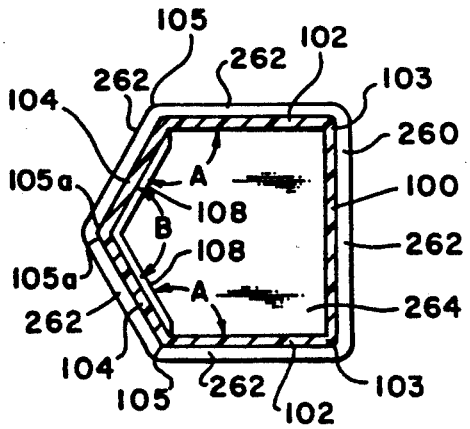
FIG. 9 is an enlarged cross-sectional view taken along lines 9—9 of FIG. 7.

Shaft 140 has a cross-section defined by four U-shaped lobes 146, 148, 150, 152, as best shown in FIG. 8. Lobes 146, 148, 150, 152, are spaced equally about central axis 74, with upper and lower paddles 154, 156 extending outwardly from first and second lobes 146, 150, respectively.

Upper paddle 154 has two vertical planar surfaces 170 between a uniform-thickness upper paddle wall 172. Upper paddle 154 further has a top edge 174 joined to an upper location 176 on the first lobe 146 at an obtuse included angle and extending downwardly and outwardly to a rounded upper corner 178. A vertical outer edge 180 extends downwardly from the upper corner 178 to a lower rounded corner 182. A horizontal lower edge 184 extends from lower corner 182 to a lower location 186 on the first lobe 146.

Lower paddle 156 has two vertical planar surfaces 200 between a uniform-thickness lower paddle 202. The lower paddle 156 further has a top edge 206 going to an upper location 208 on the second lobe 150 at an obtuse included angle and extending downwardly and outwardly to a rounded upper corner 210. A vertical outer edge 212 extends downwardly from the upper corner 210 to a lower rounded corner 214. A horizontal lower edge 216 extends from the lower corner 214 to a lower location 218 on the second lobe 150.

First lobe upper location 176 is located approximately ⅔ the length of the shaft 140 from the lower end 144 to bearing element 142. First lobe lower location 186 and second lobe upper location 208 are located approximately ⅓ the length of shaft 140 from the lower end 144. Second lobe lower location 218 is located at approximately the lower end 144 of shaft 140.

The upper and lower paddle walls 170, 200 each include three, vertically-oriented, capsule-shaped apertures 230 (FIG. 1) of equal width and unequal height. Apertures 230 are horizontally-spaced and increasing in height from the outermost apertures located most closely to outer edges 154, 212 to the innermost apertures 230 located most closely to lobes 146, 150.

Crank member 124 has a vertically cylindrical surface 240 (FIG. 7) closely interfitting with the inner cylindrical wall 46 of the bearing member 40 for smooth relative rotation. Crank handle 242 extends radially outward from a disc shaped bearing element 244. The bearing element 244 is contiguous with a top edge of the crank member cylindrical surface 240. Crank handle 242 terminates at non-rotatable knob 246.

A removable spout top 260 has five vertical walls 262 (FIGS. 5 and 9) sized to closely interfit with the five spout walls 100, 102, 104 in a sealing relationship. A horizontal central wall 264 extends between the spout top vertical walls 262.

Figure 10:
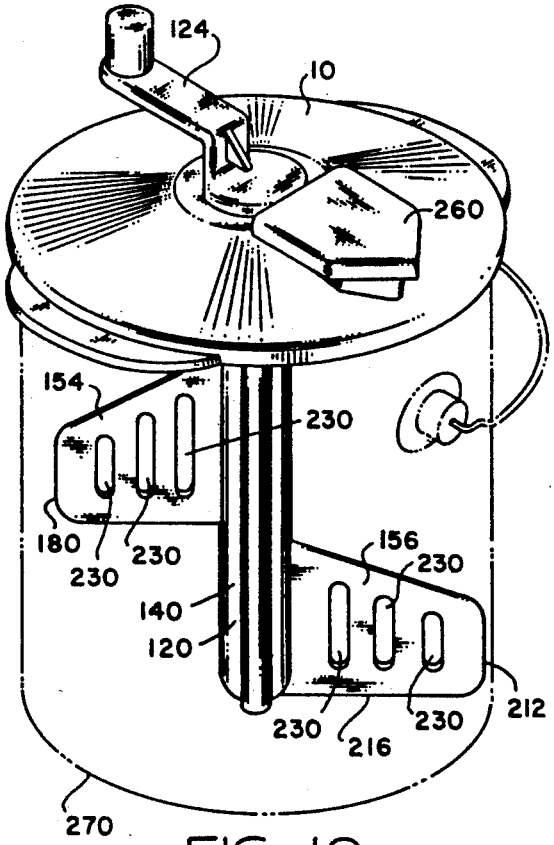
FIG. 10 is a view of the apparatus in use with a liquid container.
Figure 7:
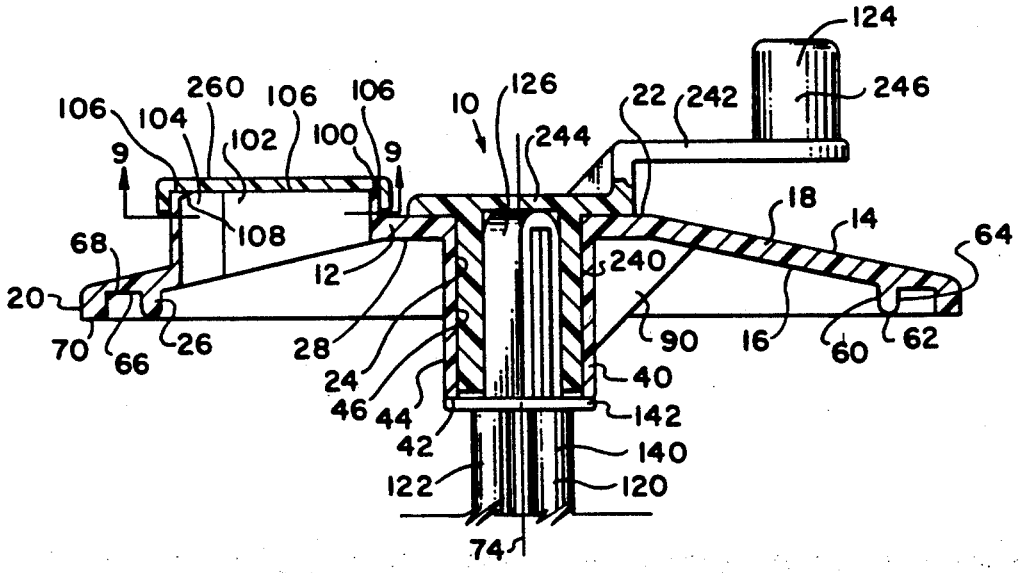
FIG. 7 is an enlarged cross-sectional view taken along lines of 7—7 of FIG. 5.

In operation, as shown in FIG. 10, apparatus 10 may be engaged with a conventional, open-topped container 270 by way of engagement member 26 and surfaces 60, 62, 64, 66, 68. As long as spout top 260 is in place, the container 270 is sealed. A liquid within container 270 may be stirred by turning crank member 124, which in turn rotates paddle member 120. Paddles 154 and 156 agitate the liquid, with lower paddle 156 constructed and arranged such that lower edge 260 is in close proximity to a bottom surface of container 270 and outer edge 212 is in close proximity to a side surface of container 270, such that the liquid and any settled particulate solids are thoroughly lifted from the container bottom and side surfaces and mixed. Specially-shaped and arranged apertures 230 enhance the mixing action by enabling agitation of the materials. Similarly, the preferred arrangement and spacing of paddles 154, 156 on shaft 140 provide an optimal balance between mixing efficiency, cost and effort required to rotate the paddle member. Outer edge 180 of upper paddle 154 preferably is spaced from the inner side surface of container 270, as best shown in FIG. 10, in contrast to outer edge 212 of lower paddle 156, to enhance turbulence in the middle portion of the container.

Inner rim surface 68 is sized to fit an outer dimension of the opening of container 270, and the engagement member surfaces 60, 62, 64 are sized and located with respect to the inner rim surface 68 to engage a standard lid engagement groove at the container opening. When molded in a flexible plastic, the sealing member snugly engages the container but is immune from the sealing action of dried paint. Handles 80 and grooves 72 enable ready removal and reuse.

Integral spout formed by spout walls 100, 102, 104 enables liquid to be poured without removing the apparatus. Pouring is enabled by removing spout top 260. Inwardly facing-facing ridges 108 prevent drips.

The four-lobed shaft is an optimal shape balancing the required stiffness for resisting forces applied by the paddles and the need to minimize the liquid volume displaced by the paddle member to prevent overflow upon insertion. Apertures 230 further help minimize the displacement of the liquid.

The combination of frustroconical walls 14 and 16 and annular walls 22 and 28 enables an elevated position for the bearing member 40 and stirring member bearing elements 142, 144, which again minimizes liquid displacement and reduces the likelihood that the bearing member will be immersed. Disc-shaped bearing elements 142 244 minimize migration of liquid and dirt into the bearing element and reduce escapage of volatile components.

Whereas the present invention has been described with respect to a specific embodiment, it will be understood that a various changes and modifications will be suggested to one skilled in the art, and it is intended to encompass such modifications.

I claim:

1. Apparatus for sealing a liquid container, comprising:

a sealing member with integral spout;

a stirring member rotatably connected to the sealing member;

a spout top constructed and arranged to seal the spout;

with the stirring member including a paddle member and a crank member, the paddle member fixed for corotation about a central axis at a top end to the crank member; and with the paddle member having a shaft depending from a bearing element to a lower end, the bearing element being in close proximity to the sealing member, the shaft having a cross-section defined by four U-shaped lobes spaced equally about the central axis.

2. The apparatus of claim 1 having upper and lower paddles extending outwardly from opposite first and second lobes, the upper paddle having two vertical planar surfaces between a uniform-thickness upper paddle wall, the upper paddle further having a top edge joined to an upper location on the first lobe at an obtuse included angle and extending downwardly and outwardly to a rounded upper corner, a vertical outer edge extending downwardly from the upper corner to a lower rounded corner, and a horizontal lower edge extending from the lower corner to a lower location on the first lobe;

the lower paddle having two vertical planar surfaces between a uniform-thickness lower paddle wall, the lower paddle further having a top edge joined to an upper location on the second lobe at an obtuse included angle and extending downwardly and outwardly to a rounded upper corner, a vertical outer edge extending downwardly from the upper corner to a lower rounded corner, and a horizontal lower edge extending from the lower corner to a lower location on the second lobe.

3. The apparatus of claim 2 with the first lobe upper location being located approximately two-thirds the length of the shaft from the lower end, the first lobe lower location and second lobe upper location being located approximately one-thirds the length of the shaft from the lower end, and the second lobe lower location being located at approximately the lower end of the shaft.

4. The apparatus of claim 2 with the upper and lower paddle walls each including three, vertically-oriented, capsule-shaped apertures of equal width and unequal height, the apertures being horizontally spaced and increasing in height from outermost apertures to innermost apertures.

5. Apparatus for sealing a liquid container, comprising:

a sealing member with integral spout;

a stirring member rotatably connected to the sealing member;

a spout top constructed and arranged to seal the spout;

with the stirring member including a paddle member and a crank member, the paddle member fixed for corotation about a central axis at a top end to the crank member; and with at least one paddle extending outwardly from a shaft of the paddle member, the paddle having two vertical planar surfaces between a uniform-thickness paddle wall, the paddle further having a top edge joined to an upper location on the shaft at an obtuse included angle and extending downwardly and outwardly to a rounded upper corner, a vertical outer edge extending downwardly from the upper corner to a lower rounded corner, and a horizontal lower edge extending from the lower corner to a lower location on the shaft.

6. Apparatus for sealing a liquid container, comprising:

a sealing member with integral spout;

a stirring member rotatably connected to the sealing member;

a spout top constructed and arranged to seal the spout;

with a one-piece, molded plastic sealing member, the sealing member having frustroconical upper and lower surfaces between a uniform-thickness sealing wall, the sealing member upper surface extending upwardly and inwardly from a cylindrical outer rim surface to an upper annular surface having a central opening, the sealing member lower surface extending upwardly and inwardly from an engagement member to a lower annular surface; and with the engagement member having a cylindrical inner surface extending downwardly from the sealing member lower surface to a curved lower surface, the engagement member further having an outer cylindrical surface extending upwardly from the curved lower surface to an upper annular rim surface, the upper annular rim surface extending horizontally outward to a cylindrical inner rim surface, and a lower annular rim surface extending between the outer and inner cylindrical rim surfaces, with the bearing member surfaces, annular surfaces, sealing member surfaces, engagement member surfaces, and rim surfaces being coaxial about a vertical, central axis, and with the inner rim surface sized to fit an outer dimension of the container opening, and the engagement member surfaces located with respect to the inner rim surface and sized to engage a lid engagement groove at the container opening.

7. Apparatus for sealing a liquid container, comprising:

a sealing member with integral spout;

a stirring member rotatably connected to the sealing member;

a spout top constructed and arranged to seal the spout;

with a one-piece, molded plastic sealing member, the sealing member have frustroconical upper and lower surfaces between a uniform-thickness sealing wall, the sealing member upper surface extending upwardly and inwardly from a cylindrical outer rim surface to an upper annular surface having a central opening, the sealing member lower surface extending upwardly and inwardly from an engagement member to a lower annular surface;

with a cylindrical bearing member depending downwardly from the lower annular surface to a bottom surface and having outer and inner cylindrical walls, the bearing member inner cylindrical wall being contiguous with the upper annular surface central opening, the bearing member outer surface adjoining the lower annular surface, with the bearing member surfaces, annular surfaces, sealing member surfaces, and rim surfaces being coaxial about a vertical, central axis; and with the lower annular rim surface having a plurality of concentric circular grooves.

8. Apparatus for sealing a liquid container, comprising:

a sealing member with integral spout;

a stirring member rotatably connected to the sealing member;

a spout top constructed and arranged to seal the spout;

with a one-piece, molded plastic sealing member, the sealing member having frustroconical upper and lower surfaces between a uniform-thickness sealing wall, the sealing member upper surface extending upwardly and inwardly from a cylindrical outer rim surface to an upper annular surface having a central opening, the sealing member lower surface extending upwardly and inwardly from an engagement member to a lower annular surface;

with a cylindrical bearing member depending downwardly from the lower annular surface to a bottom surface and having outer and inner cylindrical walls, the bearing member inner cylindrical wall being contiguous with the upper annular surface central opening, the bearing member outer surface adjoining the lower annular surface, with the bearing member surfaces, annular surfaces, sealing member surfaces, and rim surfaces being coaxial about a vertical, central axis; and with two rim handles extending outwardly from opposed portions of the rim outer surface, the rim handles having lower surfaces contiguous with the lower rim annular surface and having upper surfaces adjoining the outer rim surface at locations located about one-third the height of the outer rim surface.

9. Apparatus for sealing a liquid container, comprising:

a sealing member with integral spout;

a stirring member rotatably connected to the sealing member;

a spout top constructed and arranged to seal the spout; and with five spout walls extending vertically upward from the sealing member upper surface, the spout walls including a back wall, two side walls joined at right angles to opposite ends of the back wall, and two front walls joined at equal, obtuse angles to outer ends of the side walls, with inner ends of the side walls joined to each other at an obtuse angle, the spout walls including coplanar, horizontal, top edges forming a five-sided opening.

10. The apparatus of claim 9 with the front wall top edges having an inwardly-facing ridges for preventing drips.

11. The apparatus of claim 9 with a removable spout top having five vertical walls sized to closely interfit with the five spout walls in a sealing relationship, with a horizontal central wall extending between the spout top vertical walls.

12. Apparatus for sealing a liquid container, comprising:

a sealing member with integral spout;

a stirring member rotatably connected to the sealing member;

a spout top constructed and arranged to seal the spout; and with a cylindrical bearing member depending downwardly from the sealing member and having outer and inner cylindrical walls, the stirring member including crank member rotatably connected to the sealing member, the crank member having a vertically cylindrical surface closely interfitting with the inner cylindrical wall of the bearing member for smooth relative rotation, with a crank handle extending radially outward from a disc-shaped bearing element, the bearing element being fixed to a top edge of the crank member cylindrical surface, the crank handle terminating at a non-rotatable knob.

13. Apparatus for sealing a liquid container having an opening, comprising:

a one-piece, molded plastic sealing member, the sealing member having frustroconical upper and lower surfaces between a uniform-thickness sealing wall, the sealing member upper surface extending upwardly and inwardly from a cylindrical outer rim surface to an upper annular surface having a central opening, the sealing member lower surface extending upwardly and inwardly from an engagement member to a lower annular surface;

a cylindrical bearing member depending downwardly from the lower annular surface to a bottom surface and having outer and inner cylindrical walls, the bearing member inner cylindrical wall being contiguous with the upper annular surface central opening, the bearing member outer surface adjoining the lower annular surface;

the engagement member having a cylindrical inner surface extending downwardly from the sealing member lower surface to a curved lower surface, the engagement member further having an outer cylindrical surface extending upwardly from the curved lower surface to an upper annular rim surface, the upper annular rim surface extending horizontally outward to a cylindrical inner rim surface, and a lower annular rim surface extending between the outer and inner cylindrical rim surfaces, the lower annular rim surface having a plurality of concentric circular grooves, with the bearing member surfaces, annular surfaces, sealing member surfaces, engagement member surfaces, and rim surfaces being coaxial about a vertical, central axis;

two rim handles extending outwardly from opposed portions of the rim outer surface, the rim handles having lower surfaces contiguous with the lower rim annular surface and having upper surfaces adjoining the outer rim surface at locations located about one-third the height of the outer rim surface;

the inner rim surface sized to fit an outer dimension of the container opening, and the engagement member surfaces located with respect to the inner rim surface and sized to engage a lid engagement groove at the container opening;

three, equally-spaced, gusset members joining the bearing member outer surface with the lower annular surface and sealing member lower surface;

five spout walls extending vertically upward from the sealing member upper surface, the spout walls including a back wall, two side walls joined at right angles to opposite ends of the back wall, and two front walls joined at equal, obtuse angles to outer ends of the side walls, with outer ends of the front walls joined to each other at an obtuse angle, the spout walls including coplanar, horizontal, top edges forming a five-sided opening, with the front wall top edges having inwardly-facing ridges for preventing drips;

a stirring member rotatably connected to the sealing member, the stirring member including a one-piece, molded plastic paddle member and a one-piece, molded plastic crank member, the paddle member fixed for corotation about the central axis at a top end to the crank member;

the paddle member having a shaft depending from a bearing element to a lower end, the bearing element being a horizontal disc in close proximity to the bearing member bottom surface and sized more largely than the bearing surface bottom surface, the shaft having a cross-section defined by four U-shaped lobes spaced equally about the central axis, with upper and lower paddles extending outwardly from opposite first and second lobes;

the upper paddle having two, vertical, planar surfaces between a uniform-thickness upper paddle wall, the upper paddle further having a top edge joined to an upper location on the first lobe at an obtuse included angle and extending downwardly and outwardly to a rounded upper corner, a vertical outer edge extending downwardly from the upper corner to a lower rounded corner, and a horizontal lower edge extending from the lower corner to a lower location on the first lobe;

the lower paddle having two vertical planar surfaces between a uniform-thickness lower paddle wall, the lower paddle further having a top edge joined to an upper location on the second lobe at an obtuse included angle and extending downwardly and outwardly to a rounded upper corner, a vertical outer edge extending downwardly from the upper corner to a lower rounded corner, and a horizontal lower edge extending from the lower corner to a lower location on the second lobe;

the first lobe upper location being located approximately two-thirds the length of the shaft from the lower end to the bearing element, the first lobe lower location and second lobe upper location being located approximately one-thirds the length of the shaft from the lower end, and the second lobe lower location being located at approximately the lower end of the shaft;

with the upper and lower paddle walls each including three, vertically-oriented, capsule-shaped apertures of equal width and unequal height, the apertures being horizontally-spaced and increasing in height from outermost apertures to innermost apertures;

the crank member having a vertically-cylindrical surface closely interfitting with the inner cylindrical wall of the bearing member for smooth relative rotation, with a crank handle extending radially outward from a disc-shaped bearing element, the bearing element being contiguous with a top edge of the crank member cylindrical surface, the crank handle terminating at a nonrotatable knob; and a removable spout top having five vertical walls sized to closely interfit with the five spout walls in a sealing relationship, with a horizontal central wall extending between the spout top vertical walls.

* * * * *